US007586393B2

(12) United States Patent
Tilmans et al.

(10) Patent No.: US 7,586,393 B2
(45) Date of Patent: Sep. 8, 2009

(54) RECONFIGURABLE CAVITY RESONATOR WITH MOVABLE MICRO-ELECTROMECHANICAL ELEMENTS AS TUNING ELEMENTS

(75) Inventors: Hendrikus Tilmans, Maasmechelen (BE); Ilja Ocket, Leuven (BE); Walter De Raedt, Lint (BE)

(73) Assignee: Interuniversitair Microelektronica Centrum (IMEC) VZW, Leuven (DE)

( * ) Notice: Subject to any disclaimer, the term of this patent is extended or adjusted under 35 U.S.C. 154(b) by 18 days.

(21) Appl. No.: 11/744,609

(22) Filed: May 4, 2007

(65) Prior Publication Data

US 2007/0257750 A1 Nov. 8, 2007

Related U.S. Application Data

(60) Provisional application No. 60/798,403, filed on May 5, 2006.

(30) Foreign Application Priority Data

May 5, 2006 (EP) ..... 06113600

(51) Int. Cl.
*H01P 7/06* (2006.01)

(52) U.S. Cl. ..... 333/232; 333/231; 333/235; 333/227

(58) Field of Classification Search ..... 333/231, 333/232, 227, 230, 233, 235; 200/181; 250/226; 359/290, 291
See application file for complete search history.

(56) References Cited

U.S. PATENT DOCUMENTS

| | | | | |
|---|---|---|---|---|
| 4,677,403 | A | 6/1987 | Kich | |
| 5,739,945 | A * | 4/1998 | Tayebati | 359/291 |
| 5,784,190 | A * | 7/1998 | Worley | 359/291 |
| 6,100,477 | A * | 8/2000 | Randall et al. | 200/181 |
| 6,635,837 | B2 * | 10/2003 | Subramanian et al. | 200/181 |
| 6,747,785 | B2 * | 6/2004 | Chen et al. | 359/291 |
| 6,917,459 | B2 * | 7/2005 | Nikkel et al. | 359/290 |
| 7,015,457 | B2 * | 3/2006 | Cole et al. | 280/226 |

FOREIGN PATENT DOCUMENTS

| | | |
|---|---|---|
| EP | 1041667 A2 | 4/2000 |
| EP | 1041667 B1 | 8/2003 |
| WO | WO 02/44033 A2 | 6/2002 |

OTHER PUBLICATIONS

Mercier D. et al., 2003. A micromachined tunable cavity resonator. 33rd European Microwave Conference, Munich 2003, Piscataway, NJ, IEEE, 2:675-677, XP010680985.
International Search Report dated Sep. 17, 2007, for EP 07107027.0.

* cited by examiner

*Primary Examiner*—Rexford N Barnie
*Assistant Examiner*—Crystal L Hammond
(74) *Attorney, Agent, or Firm*—Knobbe Martens Olson & Bear LLP

(57) ABSTRACT

One inventive aspect relates to a reconfigurable cavity resonator. The resonator comprises a cavity delimited by metallic walls. The resonator further comprises a coupling device for coupling an electromagnetic wave into the cavity. The resonator further comprises a tuning element for tuning a resonance frequency at which the electromagnetic wave resonates in the cavity. The tuning element comprises one or more movable micro-electromechanical elements with an associated actuation element located in their vicinity for actuating each of them between an up state and a down state. The movable micro-electromechanical elements at least partially have a conductive surface and are mounted within the cavity.

27 Claims, 11 Drawing Sheets

RECONFIGURABLE CAVITY RESONATOR WITH MOVABLE MICRO-ELECTROMECHANICAL ELEMENTS AS TUNING ELEMENTS

CROSS REFERENCE TO RELATED APPLICATIONS

This application claims priority under 35 U.S.C. §119(e) to U.S. provisional patent application 60/798,403 filed on May 5, 2006, which application is hereby incorporated by reference in its entirety.

BACKGROUND OF THE INVENTION

1. Field of the Invention

The present invention relates to a reconfigurable cavity resonator.

2. Description of the Related Technology

Emerging millimeter wave applications such as 60 GHz wireless LAN and 77 GHz automotive radar require new system packaging concepts to realize cheap, high-performance systems with a small form factor. Key components that need to be incorporated into the package are tunable high-Q resonators and filters.

Cavity resonators at millimeter wave frequencies etched in silicon with a fixed resonant frequency have been demonstrated in the literature. The Q-factor of a cavity resonator is the ratio of stored energy over dissipated energy over a resonance cycle at the resonant frequency and is a measure of frequency selectivity. Resonators are e.g. used in oscillators where the quality factor of the resonator determines the phase noise of the oscillator.

Tunable cavity resonators have also been demonstrated and typically use an external component such as a MEMS capacitor coupled to the cavity to tune the resonant frequency of the cavity. The use of such a MEMS capacitor has the disadvantage that the tuning range is limited to a few percent, and furthermore, that the maximum attainable Q-factor is limited.

One example of such a tunable cavity resonator is disclosed in D. Mercier, M. Chatras, J. C. Orlianges, C. Champeaux, A. Catherinot, P. Blondy, D. Cros and J. Papapolymerou, "A Micromachined Tunable Cavity Resonator", 33rd European Microwave Conference, pp. 676-677, Munich, Okt. 2003. The publication describes a micromachined tunable cavity resonator at 28 GHz which uses an externally coupled MEMS capacitor. The tuning range is simulated to be 1.5% and the (unloaded) quality factor is in the range 100-150.

In U.S. Pat. No. 4,677,403 a microwave resonator is disclosed which includes a temperature-compensating structure within the resonator cavity configured to undergo temperature-induced dimensional changes which substantially minimize the resonant frequency change otherwise caused by temperature-induced changes in the waveguide body cavity. The temperature-compensating structure includes both bowed and cantilevered structures on the cavity end wall, as well as structures on the cavity sidewall such as a tuning screw of temperature-responsive varying diameter.

SUMMARY OF CERTAIN INVENTIVE ASPECTS

Certain inventive aspects relate to a reconfigurable cavity resonator with which a high tuning range and a high Q-factor can be attained.

In one aspect, the reconfigurable cavity resonator comprises a cavity delimited by metallic walls, a coupling device for coupling an electromagnetic wave into the cavity and tuning elements for tuning a resonance frequency at which the electromagnetic wave resonates in the cavity. The tuning elements comprise one or more movable micro-electromechanical elements with associated actuation elements located in their vicinity for actuating each of them between an up and a down state, and possibly one or more intermediate positions. The one or more movable micro-electromechanical elements at least partially have a conductive, preferably metallic surface and are mounted within the cavity of the resonator.

Upon actuation, the topology of the cavity is affected by the altered position of the one or more movable micro-electromechanical elements. This has an impact on the electrical length of the cavity and therefore on the resonance frequency of the cavity resonator. Simulations have indicated only a minimal effect on the Q-factor of the resonator, since the one or more movable micro-electromechanical elements as a result of their conductive surface introduce little or no resistive losses in the cavity.

The conductivity of the conductive surface of the movable micro-electromechanical elements is preferably substantially the same as that of the metallic walls of the cavity, so that any resistive losses are minimized. The conductive surface can for example be applied by depositing a metallic layer on the movable micro-electromechanical elements. The thickness of the metallic layer and the metal on the metallic walls is preferably at least two or three skin depths.

In another aspect, the movable micro-electromechanical elements comprise one or more micro-machined cantilever structures, each comprising an anchored portion and an actuatable freestanding portion which is actuatable by the actuation elements.

Preferably, the cantilever structures are anchored on a first surface of the cavity, while their freestanding portions approach a second surface of the cavity when actuated, up to a distance at which capacitive coupling occurs between the free portion and the second cavity surface or even to make galvanic contact with the second surface of the cavity. Optionally, the second surface of the cavity can be provided with an insulating layer at least at the area of the freestanding portion for minimizing the wear of the cantilever elements upon repetitive actuation. These embodiments have the advantage that upon actuation, the cantilever elements act as a cavity sidewall, thus reconfiguring the cavity volume. In this way discrete tuning of the cavity resonant frequency becomes possible with only a small effect on the cavity Q-factor.

In another aspect, a plurality of movable micro-electromechanical elements are provided, arranged side by side in one or more arrays. Preferably, multiple arrays are provided, each array having its own separately operable actuation elements and being arranged such that the resonance frequency is stepwise tunable. In this way, the resonance frequency becomes tunable in at least a number of coarse steps. The whole base plane of the cavity can be provided with "a sea of movable micro-electromechanical elements" according to a structured pattern to achieve maximal tunability of the resonator.

Preferably, the actuation elements of each of the arrays are provided for individually actuating the movable micro-electromechanical elements of the respective array, independently or combined. In this way, the resonance frequency can be fine tuned. The coarse and fine tuning together can lead to a wide continuous tuning range.

Preferably, the movable micro-electromechanical elements of one or more arrays differ in size with respect to those of one or more other arrays. This has the advantage that a number of coarse tuning steps of varying sizes can be achieved.

Preferably, the arrays are mounted according to the longitudinal or transverse direction of the base plane of the cavity, which is mostly rectangular and has a limited height.

Preferably, the cavity has a top side opposite the base plane which shows a height reduction above each of the arrays of movable micro-electromechanical elements. This height reduction is chosen such that the movable micro-electromechanical elements in their up state are located in close proximity to the top side of the cavity. This may further enhance the Q-factor of the resonator.

In another aspect, the cavity comprises a resonating part and a tuning part open towards each other, the one or more movable micro-electromechanical elements being mounted in the tuning part. This has the advantage that the tuning part can be optimized separately from the resonating part, so that the Q-factor can be further enhanced.

In another aspect, the actuation elements are provided for piezoelectrically actuating the movable micro-electromechanical elements. Piezoelectric actuation is preferred because of the high speed and the low power consumption (being substantially zero in idle state). For a micro-machined piezoelectrically actuated cantilever a variety of piezoelectric materials can be used, e.g., aluminum nitride (AlN), lead zirconate titanate (PZT) or zinc oxide (ZnO). However, other actuation mechanisms known to the person skilled in the art may also be applied in the resonator, such as for example electrostatic, electrothermal, photothermal and electromagnetic mechanisms.

In another aspect, the actuation elements are provided for actuating each of the movable micro-electromechanical elements within a continuous range of stable displacements, between the up and down states. This can further enhance the fine tuning capacity of the resonator with only a small effect on the cavity Q-factor.

In another aspect, the actuation elements are under the control of a feedback circuit, which is provided to move each movable micro-electromechanical element from its actual displacement to a desired displacement. The feedback circuit can for example obtain the displacement information from the current resonance frequency and determine whether or not an adjustment of one or more movable micro-electromechanical elements is desirable.

In another aspect, the movable micro-electromechanical actuator elements define an enclosed volume, which can be varied by the actuation elements, thereby varying the tuning range of the resonator. The enclosed volume is preferably created by an interdigitated structure. The interdigitated structure comprises a multiple of micro-machined cantilever structures.

BRIEF DESCRIPTION OF THE DRAWINGS

The invention will be further elucidated by the following description and the appended figures.

DETAILED DESCRIPTION OF CERTAIN EMBODIMENTS

Figure 1:
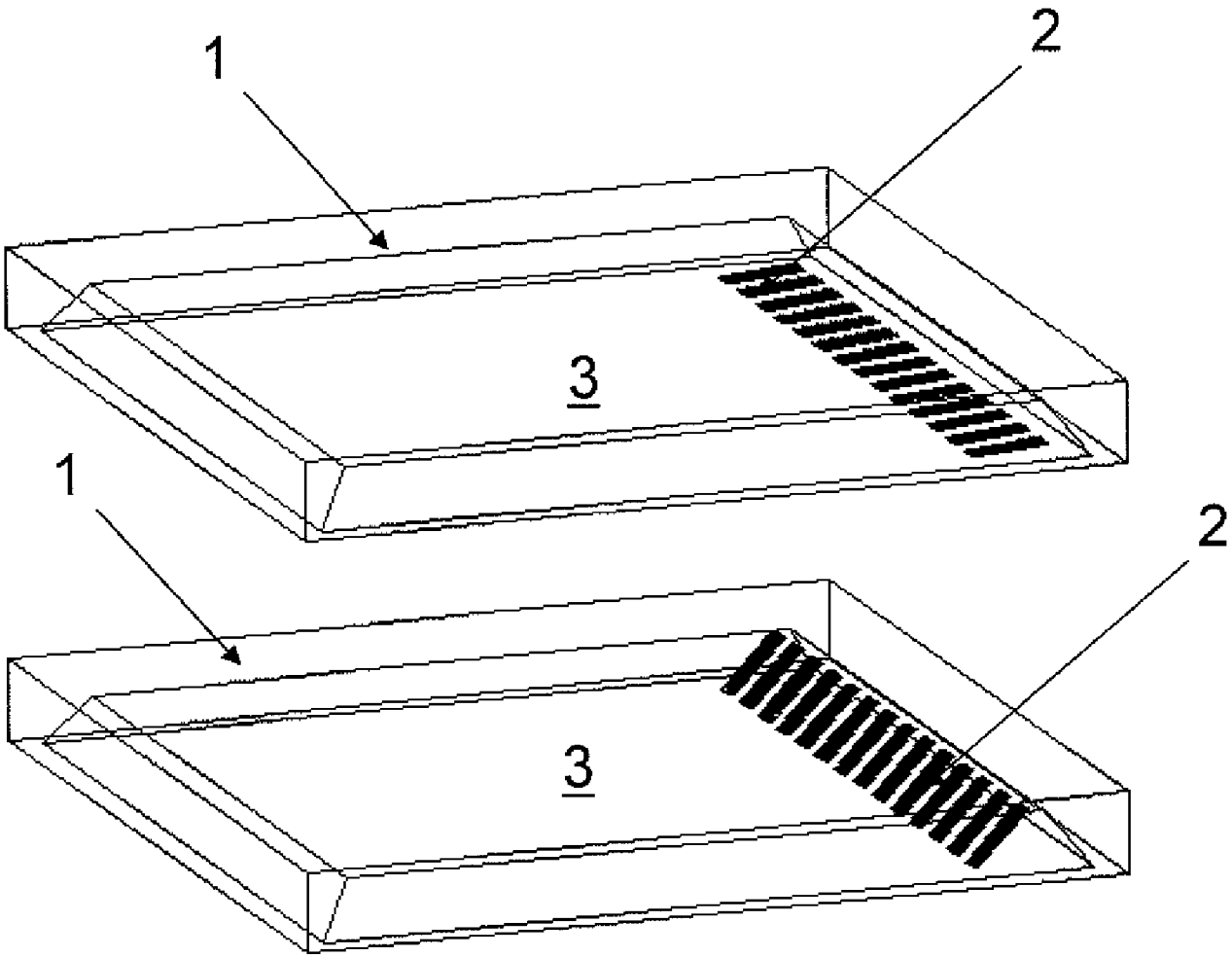
FIG. 1 shows a 3D model of a cavity resonator according to one embodiment, used for simulations.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

FIG. 1 shows a 3D model of a cavity resonator with an array of cantilevers 2 mounted inside the cavity 1. The model is used in simulations to determine the influence of cantilever positions on resonant frequency and Q-factor. The cavity surface is, for example, 3 mm by 3 mm with a height of 200 μm. The cavity is modeled as an air filled volume inside a Cu block. The metal (e.g., Cu) cantilevers are 10 μm thick, 100 μm wide and 283 μm long and are anchored at 400 μm from the edge of the cavity bottom metal plane 3. The cantilevers 2 are shown in a down state (top of FIG. 1) and an up state (bottom of FIG. 1).

As an example of a simulation by the model of FIG. 1, consider a cavity of 3×3 $mm^2$ that is KOH etched in silicon to a depth of 200 micron and metallized with Cu to a thickness greater than three skin depths at 70 GHz. On the bottom metal 3 of the cavity 1 a series of 14 Cu cantilevers 2, each 100 micron wide, 10 micron thick and 282 micron long are placed along an edge of the cavity 400 micron from the edge.

Simulations performed with a 3D full-wave electromagnetic solver (HFSS) have shown that when these cantilevers are brought upwards from their resting position to make contact with the top metal of the cavity the resonant frequency of the resulting structure is 77.46 GHz with a Q-factor of 673. The case with the cantilevers lying flat gives a resonant frequency of 74 GHz with a quality factor of 645. The same cavity without any cantilevers shows a resonant frequency of 74.03 GHz and a Q-factor of 694. These simulations show that tuning is possible with Q-factors approaching those of untuned cavity resonators.

Finer tuning of the resonant frequency with only a slightly reduced quality factor is observed when the same example as described in the previous section is calculated for intermediate cantilever positions.

Table I illustrates this fine tuning property.

TABLE 1 effect of cantilever elevation angle on resonant frequency and Q-factor for the case described in FIG. 1A.

| Elevation angle (degrees) | fres (GHz) | Q-factor |
|---|---|---|
| 5 | 74.03 | 643.6 |
| 10 | 73.98 | 631.7 |
| 15 | 73.88 | 624.25 |
| 20 | 73.76 | 612.3 |
| 25 | 73.52 | 600.7 |
| 30 | 73.26 | 588.2 |
| 35 | 72.65 | 538.6 |
| 40 | 70.11 | 435.8 |
| 45 | 77.46 | 672.7 |

The depth of the cavity will determine the maximum attainable Q-factor of the cavity, since it will be the smallest dimension; deeper cavities will have a higher Q-factor. To be able to make cantilevers that can be brought upward to contact the top metal of the cavity a shallow cavity may be required. Thus, some compromise may be needed when using a cavity with uniform depth. However, when the cavity is made such (see below) that part of the cavity is shallow (at cantilever positions) and the rest of the cavity is made deeper, then the combined Q-factor approaches that of the deeper part.

The length, width, position and shape of the cantilevers determines the discrete frequency step and the fine-tuning range achievable with one row of cantilevers 2 or even a single cantilever. By placing the cantilevers differently or by changing their length and width a different tuning behavior can be achieved.

The above simulation assume perfectly straight cantilevers that can be elevated 45 degrees. Real-world cantilevers may have limitations in freedom of movement, but the principle of operation believed to still be the same.

Figure 2:
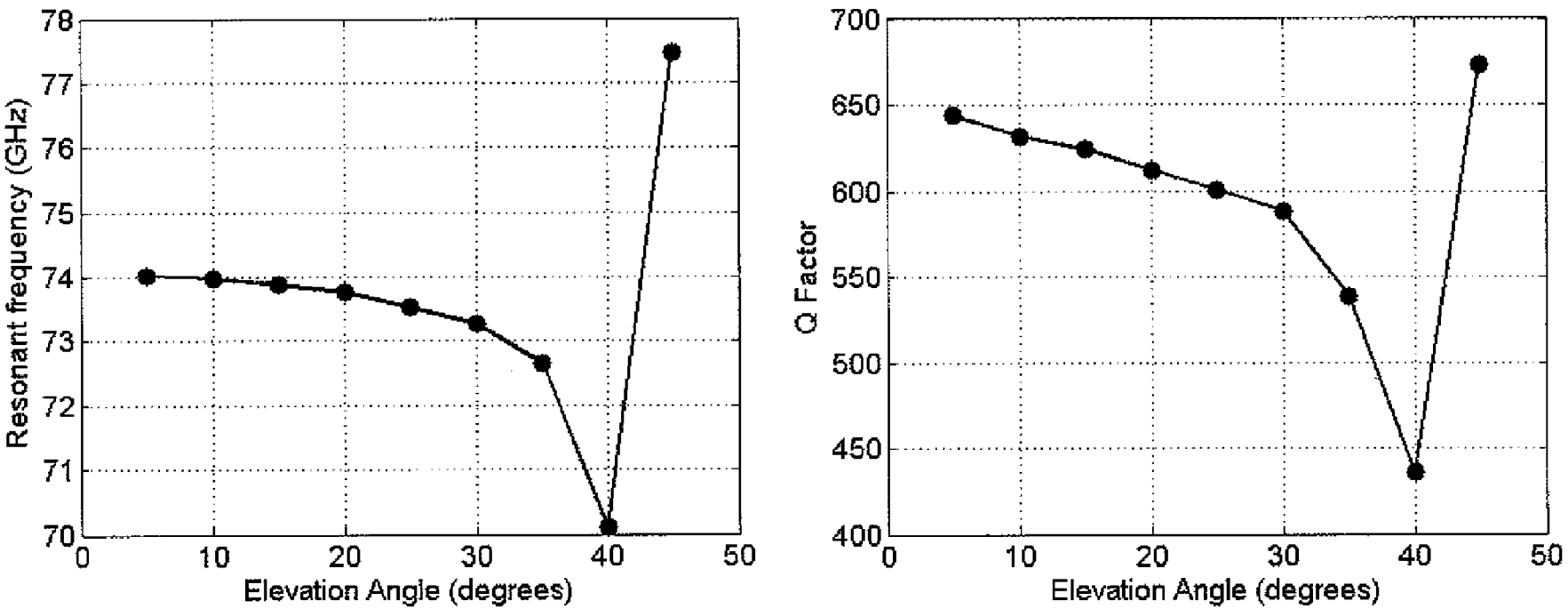
FIG. 2 shows results of simulations performed by the model of FIG. 1.

The result of the simulations by the model of FIG. 1 are shown in FIG. 2. The left and right figures show a high resonant frequency $f_{res}$ variation with near constant Q-factor when switching the cantilevers 2 between the down and up positions. At intermediate positions, a high Q-factor is achievable with a smaller $f_{res}$ variation for elevation angles of the cantilevers 2 up to 30°.

Figure 3:
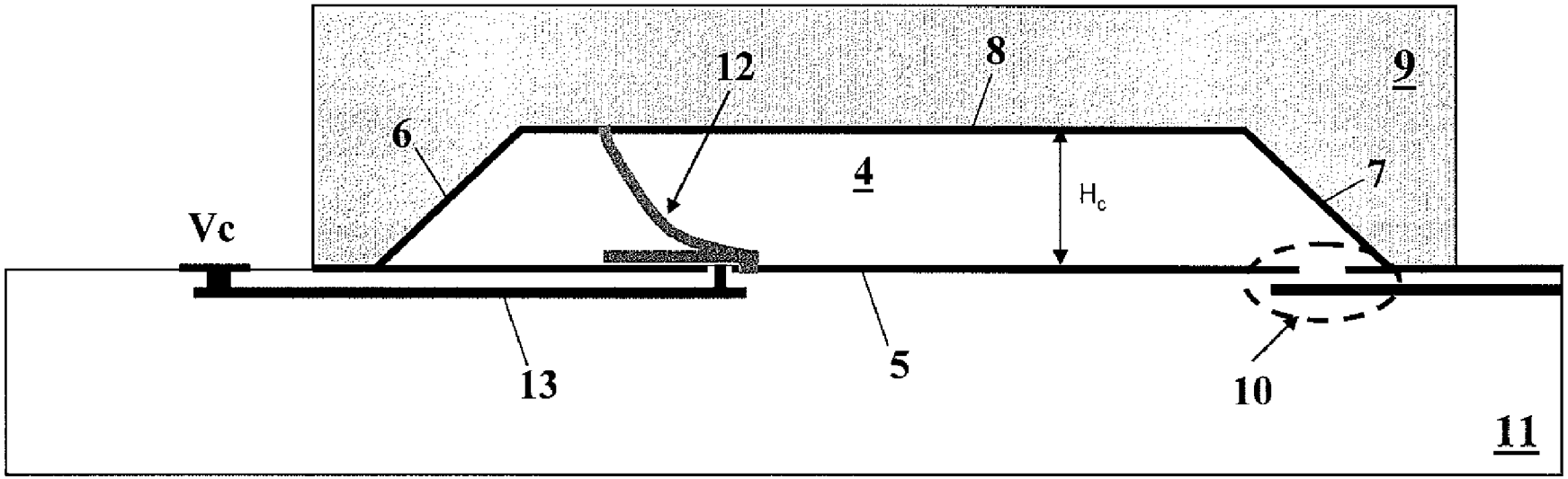
FIG. 3 shows a first embodiment of a tunable/switchable cavity resonator.

FIG. 3 shows a first embodiment of a tunable/switchable cavity resonator. The cavity resonator comprises a cavity 4 delimited by metallic walls 5-8, constructed in a first carrier 9, which is applied on a second carrier 11. A coupling device 10 is provided for coupling an electromagnetic wave from the second carrier 11 into the cavity 4. In the cavity 4, a movable micro-electromechanical cantilever element 12 is mounted, shown both in up and down state, as tuning elements for tuning a resonance frequency at which the coupled electromagnetic wave resonates in the cavity 4. Tuning is achieved by changing the deflection of the cantilever element 12, which is effected by applying a control voltage Vc to an actuation electrode 13. The cantilever 12 is preferably actuated via piezoelectric elements, but other elements like electrothermal, electromagnetic are also possible. By actuating the cantilever 12, which has a metallic surface, the volume of the cavity 4 is changed which results in a shift (and thus tuning) of the resonant frequency. Coupling of the electromagnetic wave is achieved from the bottom surface 5, i.e., the surface on to which the cantilever 12 is mounted.

Figure 4:
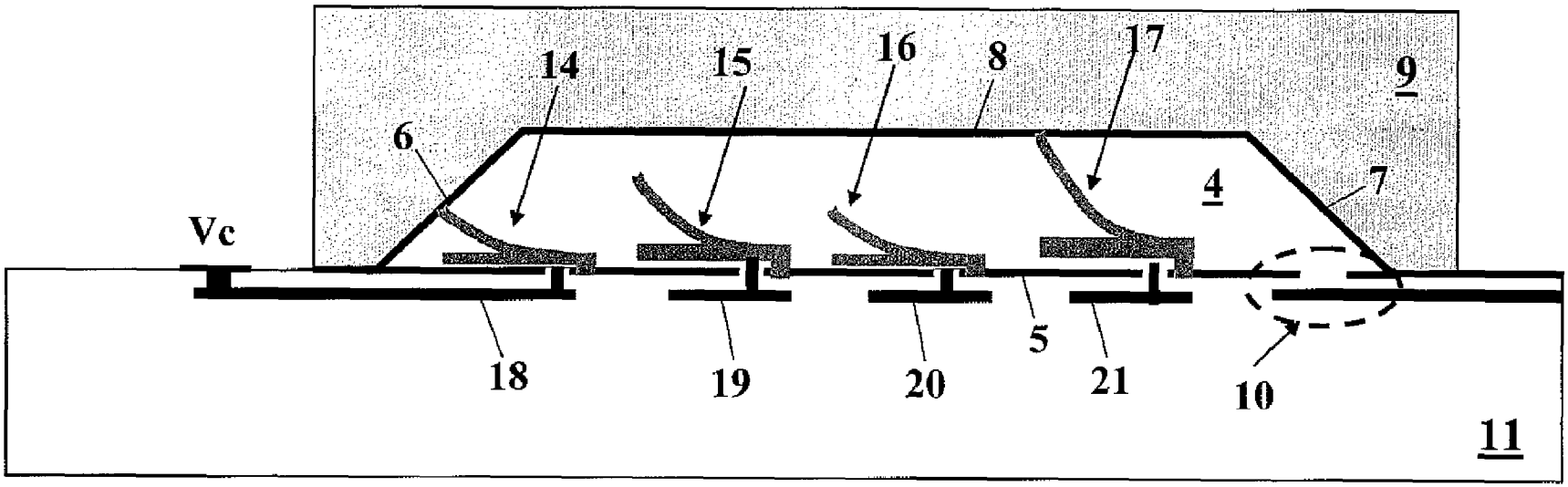
FIG. 4 shows a second embodiment of a tunable/switchable cavity resonator.

FIG. 4 shows a second embodiment of a tunable/switchable cavity resonator, which differs from that of FIG. 3 in that it comprises multiple cantilevers 14-17, each having their own actuation electrode 18-21. In this way, the different cantilevers can be independently actuated. By orchestrating the different cantilevers 14-17 in a particular way, a very wide (continuous) tuning range can be achieved.

Figure 5:
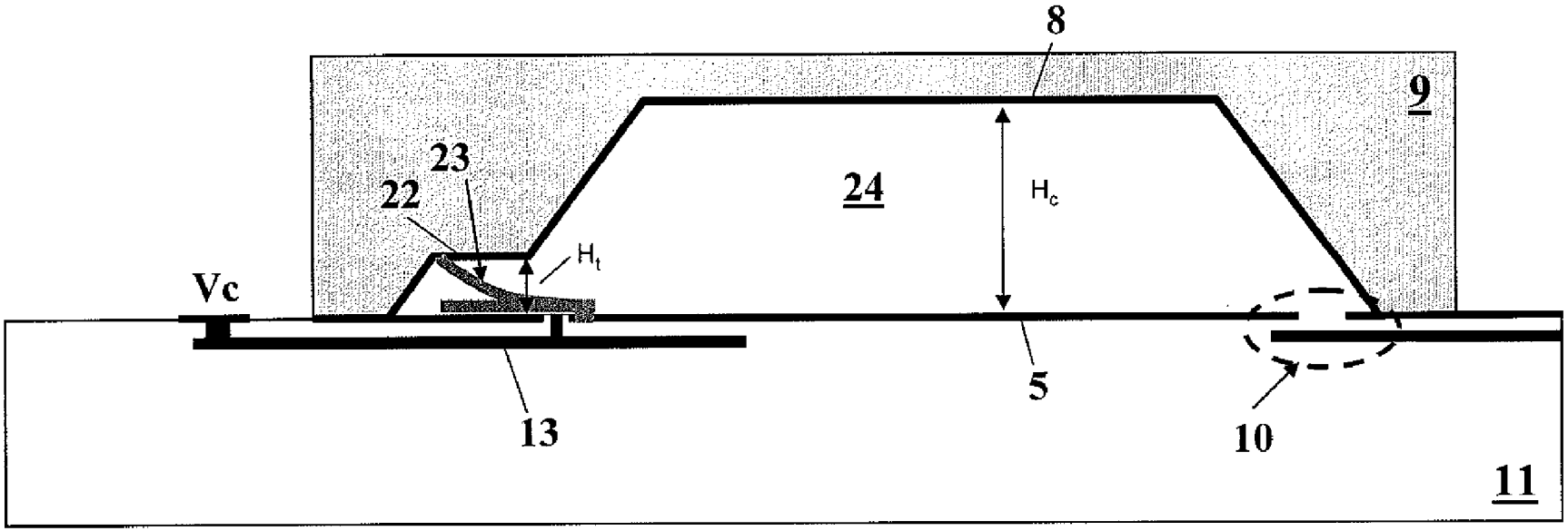
FIG. 5 shows a third embodiment of a tunable/switchable cavity resonator.

FIG. 5 shows a third embodiment of a tunable/switchable cavity resonator. Here, the resonator shows a locally recessed cavity 22 at the edge at which recess the cantilever 23 is placed. The recess 22 allows a shorter travel of the cantilever (given by the tuning height Ht) while the major part of the cavity height Hc is large which ensures a high quality factor. So in fact, this embodiment shows a resonating part 24 and a tuning part 22 open towards each other, the movable micro-electromechanical cantilever element 23 being mounted in the tuning part 22.

Figure 6:
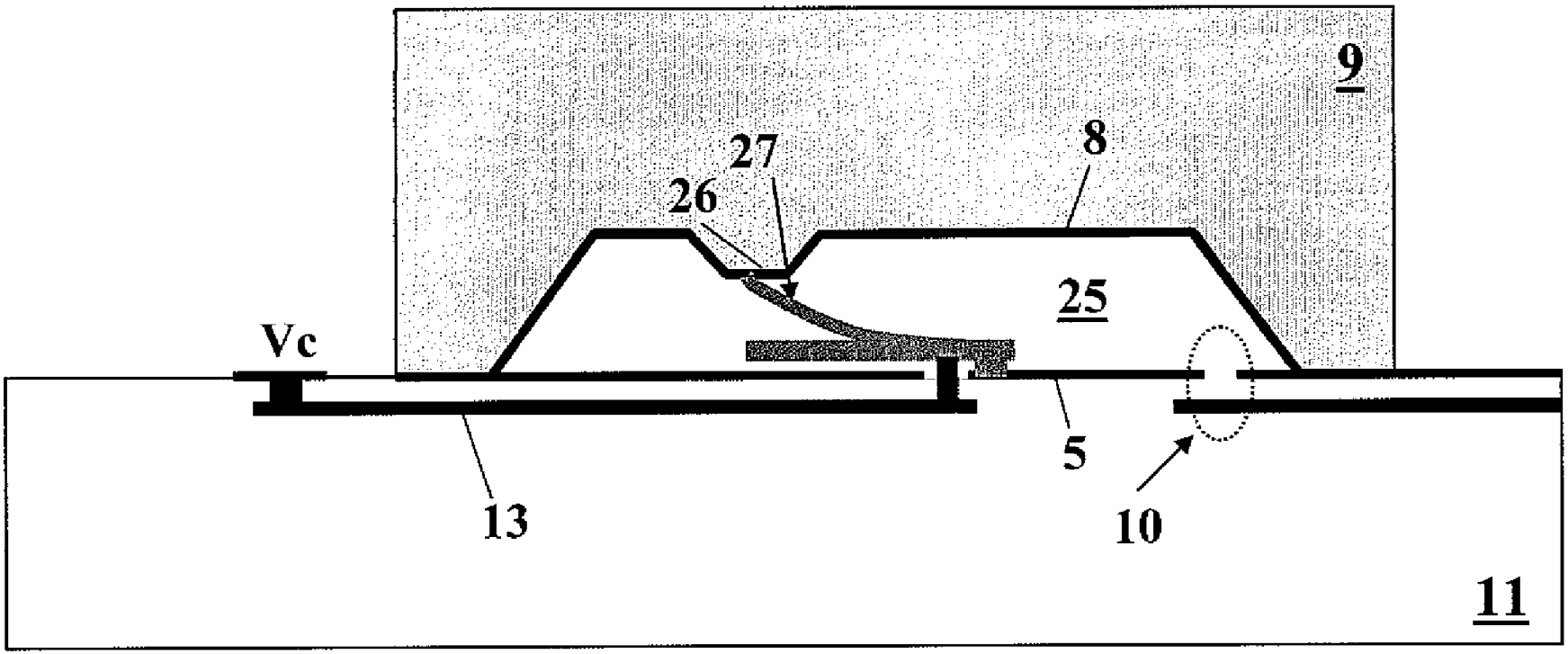
FIG. 6 shows a fourth embodiment of a tunable/switchable cavity resonator.

FIG. 6 shows a fourth embodiment of a tunable/switchable cavity resonator. Here, the resonator shows a locally recessed cavity 25 away from the edge. The cantilever 27 is placed at the recess 26 so that part of the cavity can be substantially shut off.

Figure 7:
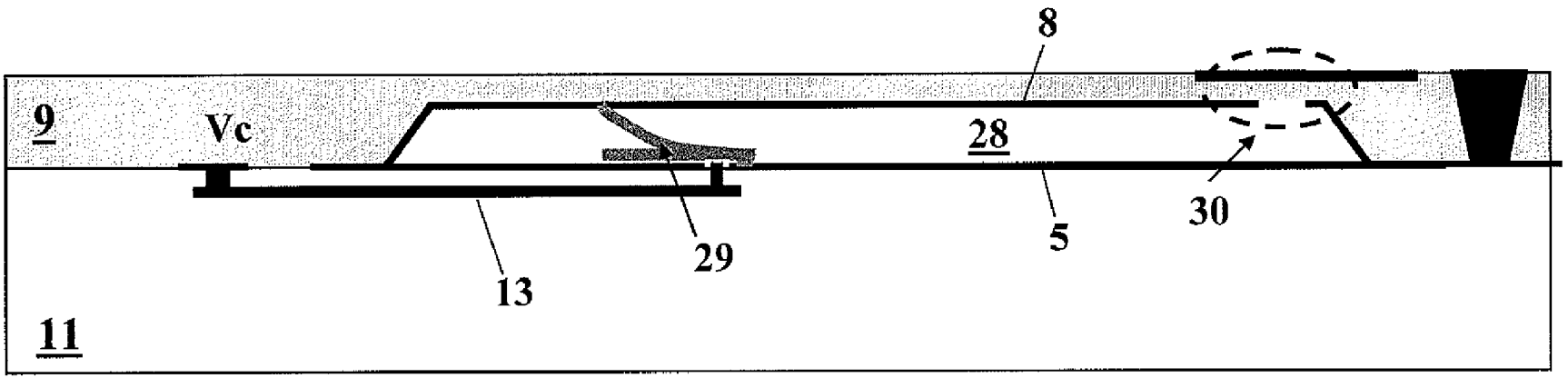
FIG. 7 shows a fifth embodiment of a tunable/switchable cavity resonator.

FIG. 7 shows a fifth embodiment of a tunable/switchable cavity resonator. Here, the cavity 28 is more shallow and the coupling device is in the top surface 8 instead of in the bottom surface 5 on which the cantilever 29 is mounted.

Figure 8:
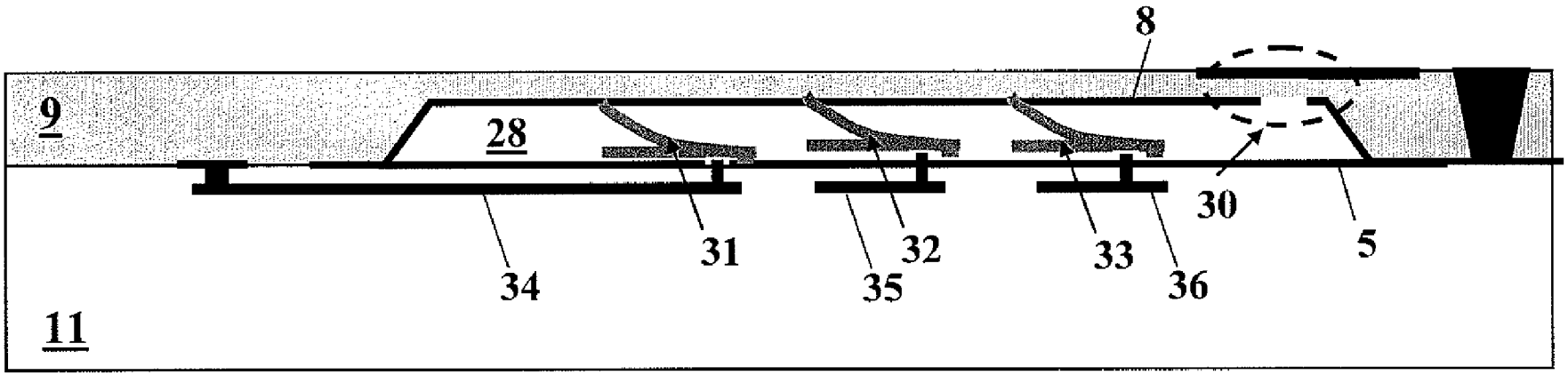
FIG. 8 shows a sixth embodiment of a tunable/switchable cavity resonator.

FIG. 8 shows a sixth embodiment of a tunable/switchable cavity resonator, which differs from that of FIG. 7 in that it comprises multiple cantilevers 31-33, each having their own actuation electrode 34-36. In this way, the different cantilevers can be independently actuated. By orchestrating the different cantilevers 31-33 in a particular way, a very wide (continuous) tuning range can be achieved.

Figure 9:
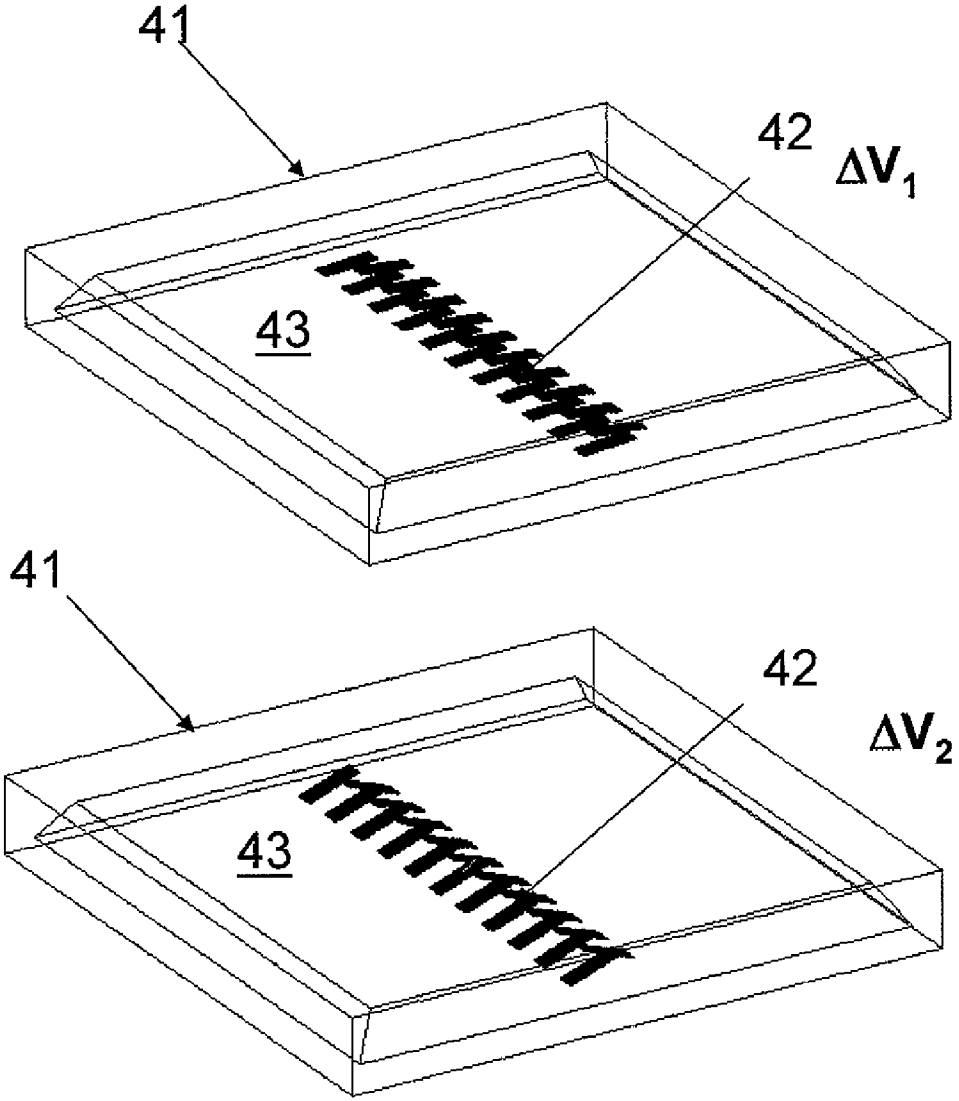
FIG. 9 shows 3D model of a seventh embodiment of a tunable/switchable cavity resonator.

FIG. 9 shows a 3D model of a cavity resonator with an array of cantilevers 42 mounted inside the cavity 41. The model is used in simulations to determine the influence of cantilever positions on resonant frequency and Q-factor. The cavity surface is 3 mm by 3 mm with a height of 5200 μm. The cavity is modeled as an air filled volume inside a Cu block. The metal (Cu) cantilevers are 10 μm thick, 100 μm wide and 283 μm long and are anchored at 400 μm from the edge of the cavity bottom metal plane 43. The cantilevers 42 are shown in a down state (top of FIG. 9) and an up state (bottom of FIG. 9).

Figure 10:
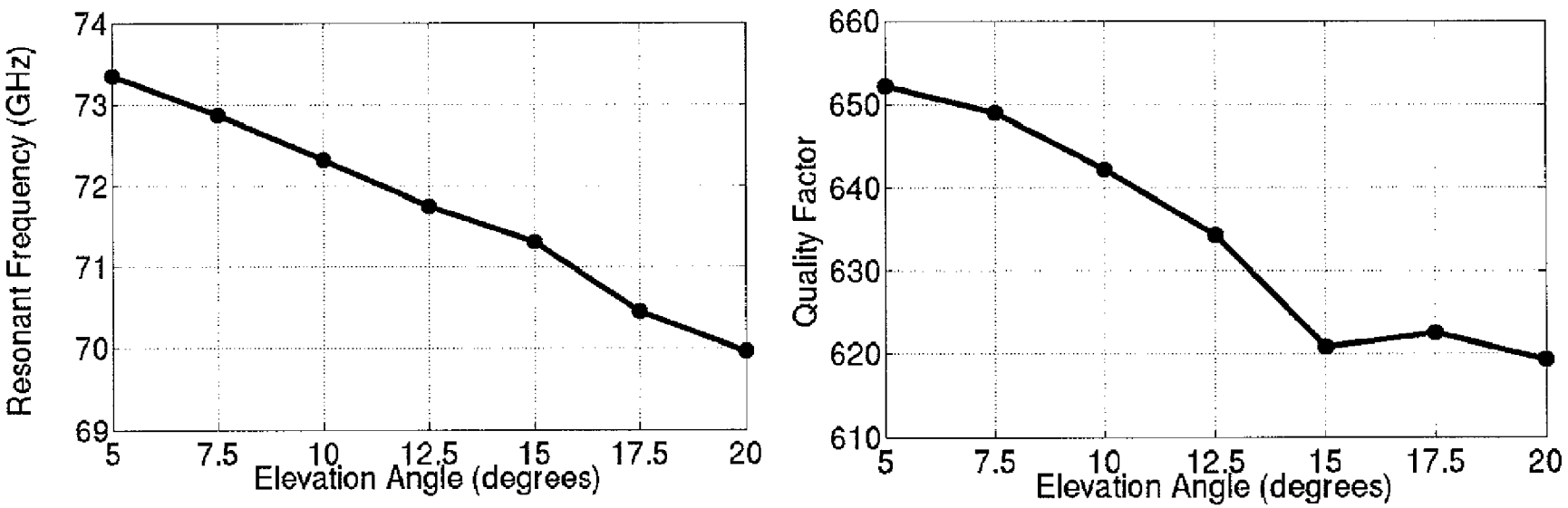
FIG. 10 shows results of simulations performed by the model of FIG. 9.

The results of the simulations by the model of FIG. 9 are shown in FIG. 10. The left and the right figures show a high resonant frequency $f_{res}$ variation with near constant Q-factor when switching between $\Delta V_1$ and $\Delta V_2$.

Figure 11:
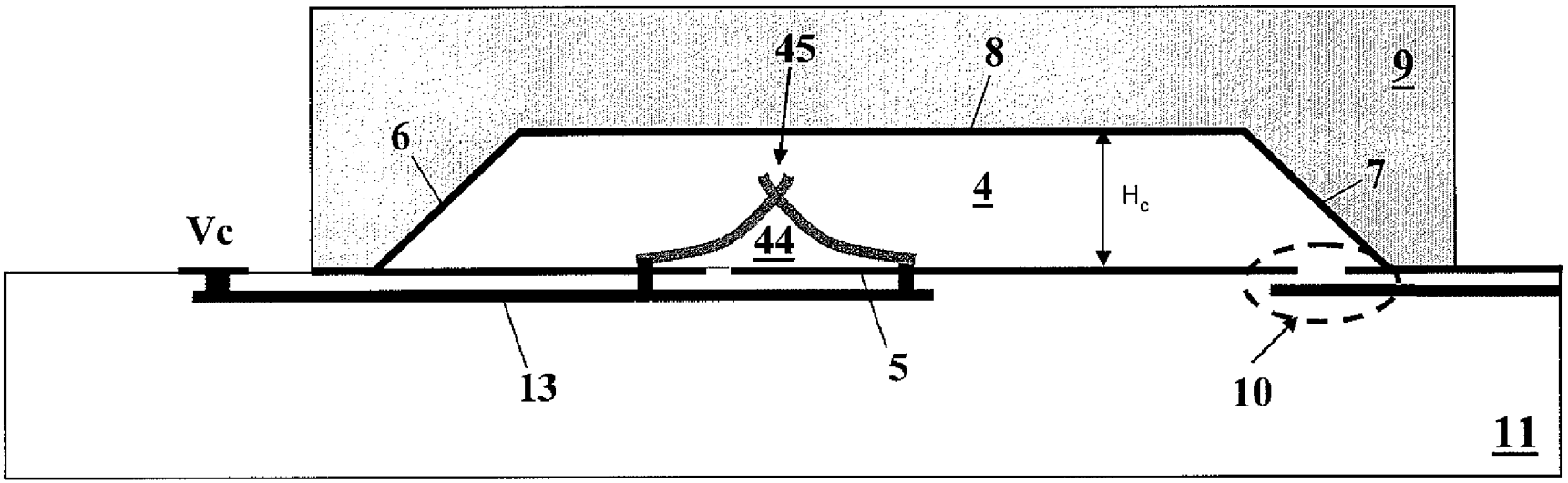
FIG. 11 shows a seventh embodiment of a tunable/switchable cavity resonator.

FIG. 11 shows another embodiment of a tunable/switchable cavity resonator. This embodiment differs from that of FIG. 3 in that it comprises an interdigitated structure 45 forming an enclosed volume 44. By the interdigitated structure 45 the enclosed volume 44 is subtracted from the volume of the cavity 4. By altering the position of the cantilevers of the interdigitated structure 45, the subtracted volume 44 is also altered and a wide tuning range can be achieved.

In each of the above described embodiments, the cantilever elements may be arrays of cantilever embodiments which are placed side by side as shown in FIG. 1. Separate actuation electrodes may be provided for individually actuating the cantilevers, which increases the fine tuning capability of the shown resonator embodiments.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A reconfigurable cavity resonator comprising:

a cavity delimited by metallic walls, a coupling device for coupling an electromagnetic wave into the cavity; and a tuning element for tuning a resonance frequency at which the electromagnetic wave resonates in the cavity, wherein the tuning element comprises at least one movable micro-electromechanical element within the cavity with associated an actuation element located in its vicinity for actuating the moveable element between an up state and a down state, the movable micro-electromechanical elements at least partially having a conductive surface and being mounted within the cavity.

2. The resonator according to claim 1, wherein the conductivity of the conductive surface of the movable micro-electromechanical element is substantially the same as that of the metallic walls of the cavity.

3. The resonator according to claim 1, wherein the conductive surface of the movable micro-electromechanical elements is formed as a deposited metallic layer.

4. The resonator according to claim 3, wherein the thickness of the metallic layer and the metal on the metallic walls is at least two or three skin depths.

5. The resonator according to claim 1, wherein the movable micro-electromechanical element comprises one or more micro-machined cantilever structures, each comprising an anchored portion and an actuatable freestanding portion which is actuatable by the actuation element.

6. The resonator according to claim 5, wherein the anchored portion is anchored on a first surface of the cavity and the freestanding portion approaches a second surface of the cavity when actuated, up to a distance at which capacitive coupling occurs between the freestanding portion and the second cavity surface.

7. The resonator according to claim 6, wherein the second surface of the cavity is provided with an insulating layer at least at the freestanding portion for minimizing the wear of the cantilever elements upon repetitive actuation.

8. The resonator according to claim 5, wherein galvanic contact is made between the freestanding portion when actuated and the second surface of the cavity.

9. The resonator according to claim 1, wherein the resonator comprises a plurality of the movable micro-electromechanical elements arranged side by side in one or more arrays.

10. The resonator according to claim 9, wherein multiple arrays of movable micro-electromechanical elements are provided within the cavity, each array being provided with separately operable actuation elements, the arrays being arranged such that the resonance frequency is stepwise tunable.

11. The resonator according to claim 9, wherein the actuation elements of each array are provided for individually actuating the movable micro-electromechanical elements of the respective array.

12. The resonator according to claim 9, wherein the movable micro-electromechanical elements of at least a first of the arrays differ in size with respect to the micro-electromechanical elements of at least a second of the arrays.

13. The resonator according to claim 9, wherein one of the metallic walls is a rectangular plane on which each of the arrays of movable micro-electromechanical elements is mounted along its longitudinal or transverse direction, the cavity having a limited height perpendicular to the base plane.

14. The resonator according to claim 13, wherein the cavity has a top side opposite the base plane which shows a height reduction above each of the arrays of movable micro-electromechanical elements, the height reduction being chosen such that the movable micro-electromechanical elements in their up state are located in close proximity to the top side of the cavity.

15. The resonator according to claim 1, wherein the cavity comprises a resonating part and a tuning part open towards each other, the movable micro-electromechanical element being mounted in the tuning part.

16. The resonator according to claim 1, wherein the actuation element is provided for piezoelectrically actuating the movable micro-electromechanical element.

17. The resonator according to claim 1, wherein the actuation element is provided for actuating the movable micro-electromechanical element within a continuous range of stable displacements.

18. The resonator according to claim 17, wherein the actuation element is controlled by a feedback circuit to move the micro-electromechanical element from an actual displacement to a desired displacement.

19. The resonator according to claim 1, wherein the movable micro-electromechanical element defines an enclosed volume which is variable by movement of the micro-electromechanical element.

20. The resonator according to claim 19, wherein the movable micro-electromechanical element forms an interdigitated structure.

21. The resonator according to claim 1, wherein the metal walls are fixed.

22. The resonator according to claim 1, wherein the tuning element is separate from the metal walls.

23. The resonator according to claim 1, wherein, in one of the up and down states, the moveable micro-electromechanical element is configured to divide the cavity into two parts, and wherein the electromagnetic wave resonates in only one of the two parts.

24. A tunable cavity resonator comprising:

a micro-electromechanical element mounted within a cavity and moveable between at least a first and a second position, wherein the cavity has a different resonance frequency when the movable clement is at the first position from one when the movable element is at the second position.

25. The tunable cavity resonator of claim 24, further comprising an actuation element configured to control the position of the movable element.

26. The tunable cavity resonator of claim 24, wherein the actuation element comprises an electrode, and wherein the position of the movable element is controlled by a voltage applied to the electrode.

27. A cavity resonator comprising:

a cavity delimited by metallic walls;

means for coupling an electromagnetic wave into the cavity; and means for tuning a resonance frequency at which the electromagnetic wave resonates in the cavity, the tuning means further comprises:

at least one movable micro-electromechanical element within the cavity, the movable micro-electromechanical element at least partially having a conductive surface and being mounted within the cavity; and means for actuating the movable micro-electromechanical element between an up state and a down state.

* * * * *